US007450141B2

(12) United States Patent
Yamamoto

(10) Patent No.: US 7,450,141 B2
(45) Date of Patent: Nov. 11, 2008

(54) INK SHEET CARTRIDGE

(75) Inventor: Hideki Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 406 days.

(21) Appl. No.: 11/315,104

(22) Filed: Dec. 23, 2005

(65) Prior Publication Data

US 2006/0139437 A1 Jun. 29, 2006

(30) Foreign Application Priority Data

Dec. 24, 2004 (JP) ..... 2004-374378

(51) Int. Cl.
*B41J 32/00* (2006.01)
*B41J 17/32* (2006.01)

(52) U.S. Cl. ..... 347/214; 400/208

(58) Field of Classification Search ..... 347/214; 400/208

See application file for complete search history.

(56) References Cited

U.S. PATENT DOCUMENTS

| | | | | |
|---|---|---|---|---|
| 6,550,756 | B2 | 4/2003 | Trovinger | |
| 6,595,710 | B2 | 7/2003 | Hayashi | |
| 6,621,510 | B2 | 9/2003 | Hayashi | |
| 6,827,510 | B2 | 12/2004 | Hayashi | |
| 7,102,659 | B2 * | 9/2006 | Hayashi | 347/214 |
| 2002/0024583 | A1 | 2/2002 | Hayashi | |
| 2003/0047635 | A1 | 3/2003 | Hiraoka | |
| 2004/0136766 | A1 | 7/2004 | Hayashi | |
| 2005/0063755 | A1 | 3/2005 | Hayashi | |

FOREIGN PATENT DOCUMENTS

| | | | |
|---|---|---|---|
| CN | 1321581 | A | 11/2001 |
| EP | 1293352 | A1 | 3/2003 |
| EP | 1334835 | A2 | 8/2003 |
| JP | 61-222772 | A | 10/1986 |
| JP | 2-50871 | A | 2/1990 |
| JP | 07-266652 | A | 10/1995 |
| JP | 2001-277628 | A | 10/2001 |
| JP | 2003-300352 | A | 10/2003 |

OTHER PUBLICATIONS

EP Search Report dtd Jun. 7, 2006, EP Appln. 05257896.0-2304.
CN Office Action dtd Aug. 31, 2007, CN Application No. 2005101321689.

* cited by examiner

*Primary Examiner*—Huan H Tran
(74) *Attorney, Agent, or Firm*—Banner & Witcoff, Ltd.

(57) ABSTRACT

An ink cartridge has a supply core tube that supplies an ink sheet rolled around the supply core tube and a take-up core tube that takes up the ink sheet supplied from the supply core tube. The supply core tube and the take-up core tube are rotatably supported by a frame via supporting shafts provided at both ends of each of the supply core tube and the take-up core tube. The supply core tube may be provided with a connecting mechanism that connects a supply side supporting shaft, which is one of the supporting shafts provided at both ends of the supply core tube, with the supply core tube, and at least one through opening formed at one longitudinal end portion of the supply core tube. The opening allows a tool to be inserted therethrough to access the connecting mechanism for disengaging the connection.

15 Claims, 11 Drawing Sheets

INK SHEET CARTRIDGE

CROSS REFERENCE TO RELATED APPLICATION

This application claims priority from Japanese Patent Application No. 2004-374378, filed on Dec. 24, 2004, the entire subject matter of which is incorporated herein by reference.

FIELD

Aspects of the invention relate to an ink sheet cartridge which can be employed in a thermal transfer type image forming device such as a printer and a facsimile device.

BACKGROUND

In general, a thermal transfer printer employs an ink sheet cartridge which eases replacement of an ink sheet, i.e., handling of the thermal printer. In particular, when the thermal printer is configured as a line printer, a wide ink sheet is used.

Typically, an ink sheet cartridge is configured to have an ink sheet supplying core tube and an ink sheet take-up core tube. Each of the ink sheet supplying core tube and the ink sheet take-up core tube is rotatably mounted on a pair of bearing portions of a cartridge frame with detachable spools attached on both longitudinal (i.e., axial) ends of the core tube.

When the ink sheet is exhausted, the take-up core tube that has the used ink sheet rolled therearound and the supply core tube are taken out of the cartridge frame, and a new ink sheet set with a take-up core tube and a supply core tube having a new ink sheet rolled therearound is attached to the cartridge frame.

To exchange the ink sheets, particularly, to load the new ink sheet set as described above is relatively troublesome. A user may not understand how to exchange the ink sheet even if he/she reads an instruction manual, or in a worse case, the user may not finish the exchange operation completely.

To ease such an exchange operation, some image forming devices are configured such that cartridge frames are exchanged with the ink sheet set being accommodated therein. According to such a configuration, it becomes unnecessary for the user to set the ink sheet in the cartridge frame. The user only replaces the ink sheet cartridge with a new one, which significantly eases the operation of the user.

To achieve the above configuration, however, it is necessary that the ink sheet set be securely accommodated in the cartridge frame so that the core tubes do not become disconnected from the cartridge frame. On the other hand, in view of environmental concerns, material categorized disposal of waste is proceeding in various fields, and it is preferable that the ink sheet cartridge is configured such that the used ink sheet set can be separated from the cartridge frame, and further, that individual components constituting the ink sheet set can be separated for disposal. Thus, it is preferable that the cartridge be decomposed easily for disposal.

As discussed above, it can be difficult to disconnect the ink sheet set from the cartridge frame when the cartridges are being exchanged on one hand, while allowing the ink sheet set to be removed from the cartridge frame for disposal (e.g., after the ink sheet has been completely wound up on the take-up core tube) on the other hand.

To fulfill the above-described contradictory requirements, Japanese Patent Provisional Publication No. P2003-300352A discloses an improved ink sheet cartridge, which is configured such that shaft insertion openings are formed on the cartridge, and shaft supporting portions are formed at each opening. When the shaft is inserted in the openings, the supporting portions are deformed in a shaft inserting direction within an elastically deformable range, while when the shaft is removed, the supporting portions deform in the opposite direction beyond the elastically deformable range.

According to such a conventional cartridge, when the shaft is mounted, the supporting portions recover their original shape after the shaft is fully inserted in the openings, and the shaft is supported by the shaft supporting portions. When the shaft is removed, the shaft supporting portions deform to allow the shaft to be removed smoothly. Therefore, after the ink sheet has been used up, the user can take apart the ink sheet cartridge for categorized disposal.

According to the configuration described above, the shaft is supported by the shaft supporting portions, which are elastically deformable. Therefore, depending on how the ink sheet cartridge is handled, the shaft may be disconnected unintentionally.

Further, when the shaft is dismounted, the shaft supporting portions are deformed beyond the elastically deformable range. That is, when the shaft is removed, the shaft supporting portions are plastically deformed, or completely broken. Therefore, once the mounted shaft is dismounted, it is impossible to mount the shaft since the shaft supporting portions cannot support the shaft.

SUMMARY

Aspects of the present invention provide an ink sheet cartridge which is configured such that the core tubes will not be disconnected from the cartridge when the cartridge is in use. However, when the ink sheet is used up and the surface of the supply core tube is exposed to outside, the supply core tube can be removed from the cartridge relatively easily.

BRIEF DESCRIPTION OF THE ACCOMPANYING DRAWINGS

DETAILED DESCRIPTION

General Overview of Aspects

Figure 1:
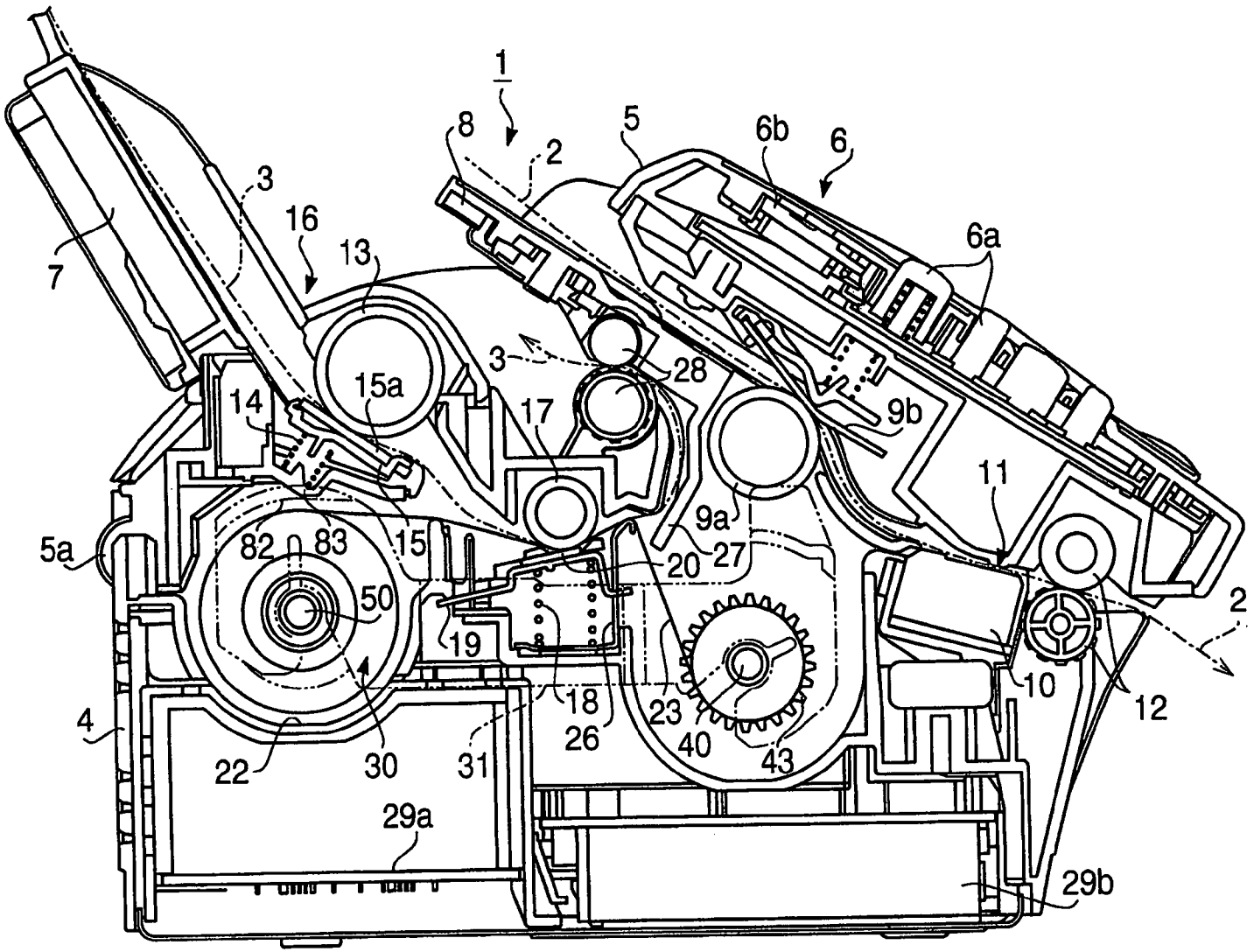
FIG. 1 is a cross-sectional side view of a facsimile device according to aspects of the invention.

The following describes general aspects of the invention that may or may not be included in various embodiments/modifications. Also, it is noted that various connections are set forth between elements in the following description. It is noted that these connections in general and, unless specified otherwise, may be direct or indirect and that this specification is not intended to be limiting in this respect.

According to aspects of the invention, there is provided an ink cartridge including a supply core tube configured to supply an ink sheet rolled around the supply core tube; a take-up core tube configured to take-up the ink sheet supplied from the supply core tube; a frame; and supporting shafts provided at both ends of each of the supply core tube and the take-up core tube. The frame rotatably supports the supply core tube and the take-up core tube via the supporting shafts. The supply core tube includes a connecting mechanism that connects a supply side supporting shaft, which is one of the supporting shafts provided at both ends of the supply core tube, with the supply core tube; and at least one opening formed at one longitudinal end portion of the supply core tube, the at least one opening allowing a tool to be inserted therethrough to access the connecting mechanism for disconnecting the supplying core tube and the supply side supporting shaft.

With the above configuration, when the ink sheet wound around the supply core tube is fed and taken up by the take-up core tube and the surface of the supply core tube (at least a portion where the through openings are formed) is exposed, the user can insert a tool (e.g., a rod-like tool) through the opening and disconnect the supply core tube and the supply side supporting shaft. Then, the user can withdraw the supply side shaft member easily.

When the ink sheet is wound around the supply core tube, since the through openings are covered with the ink sheet, the user cannot insert the rod-like tool via the through openings to disconnect the supply core tube and the supply side supporting shaft, and thus, the core tube can be securely supported by the frame.

With the ink cartridge configured as above, when the supply core tube is in use (i.e., when the through openings are covered with the ink sheet wound around the core tube), the supply core tube will not be removed from the frame easily, and after the ink sheet has been exhausted (i.e., when the surface of the supply core tube is exposed), the supply core tube can be disconnected from the frame easily by using the tool via the through openings. As a result, at least the supply core tube and the frame can be discarded separately.

The supply side supporting shaft may include a member that releases a state in which the supply side supporting shaft is supported by the frame inside the supply core tube. The at least one opening allows the tool to be inserted for causing the member to release the state in which the supply side supporting shaft is supported by the frame.

With the above configuration, a state in which the supply side supporting shaft is supported by the frame can be released when the tool, through the through openings or directly, causes the member to release the state. Thus, the user can withdraw the supply core tube from the frame easily.

The supply side supporting shaft may include a connecting section having an insertion unit configured to be inserted in the supply core tube, and a shaft member that rotatably supports the supply core tube with respect to the frame when the supply side supporting shaft is inserted in a supporting hole formed on the frame and an end portion of the shaft is connected with the connecting section. The member may be configured to connect an end of the shaft member and the connecting section, the connecting section disconnecting from the shaft member when the tool is inserted through the at least one opening from outside of the supply core tube for causing disconnection.

Thus, by operating the member with the tool inserted through the opening, the connected state can be released easily and the shaft member can be separated from the connecting section, which allows the user to withdraw the supply core tube from the frame easily.

The connecting section may include an elastic member that contacts the frame and applies an elastic force to the frame in a direction of the axis of the supply core tube. Further, on an end portion of the shaft member opposite to the connecting section with the frame arranged therebetween, a flange portion having a surface perpendicular to the axis of the shaft member may be provided. The surface perpendicular to the axis of the shaft member may be pressed against the frame by the elastic force generated by the elastic member.

By the elastic force of the elastic member, the connecting section tends to separate, together with the shaft member, from the frame in the axial direction. However, the movement is restricted by the flange portion formed on the other end of the shaft member. As a result, the flange portion is pressed against the frame by the elastic force of the elastic member. With this configuration, when the flange rotates, while being pressed onto the frame, it rotates against the frictional force caused by being pressed onto the frame.

As the frictional force is applied to the supply core tube, the supply core tube does not rotate until a certain tension is applied to the ink sheet. Thus, slack in the ink sheet can be prevented.

The elastic member may be fixed to the connecting section with a simple structure in which the elastic member simply contacts the connecting section. However, if the structure is too simple, the elastic member may fall off of the core tube during rotation of the supply core tube. On the other hand, if the elastic member is securely fixed onto the connecting section (e.g., by adhesion or welding), it would be difficult to separate the connecting section and the elastic member after the ink sheet is exhausted. In such a case, if the connecting section and the elastic member are made of different material, separation would become difficult.

In view of the above, the connecting section may be provided with a member that detachably fixes the elastic member to the connecting member.

With the above configuration, when in use, the elastic member will not be detached from the connecting section, while after use, the elastic member can be detached by an appropriate method depending on the fixing (attaching) method, for example, by pulling the same with a certain force. Further, if the elastic member is attached using the member, it may be possible to prevent the elastic member from springing out from the connecting section due its elasticity when the connecting mechanism is decomposed.

A felt member may be interposed between the flange portion and the frame, and protrusions may be formed on the surface of the frame corresponding to the flange portion, the protrusions protruding into the felt member.

Further, coaxial annular grooves may be formed on the flange portion facing the frame with the felt member interposed therebetween.

The outer diameter of the supply core tube may be substantially equal to the outer diameter of the connection section. The supply core tube may be formed with at least one stopper groove, and the connection section may be formed with at least one stopper protrusion that is configured to fit in the at least one stopper groove formed on the supply core tube.

With this configuration, the position of the connecting section with respect to the supply core tube can be adjusted exactly. Further, the position of the connecting structure with respect to (viewed from) the openings can be fixed, which enables the user to perform the connecting/disconnecting operation easily.

The connection section may include an engaging groove formed on the shaft member at a side end portion along a circumferential direction of the shaft member, and an engaging pawl extending from the insertion unit toward the longitudinal center of the supply core tube along the axial direction thereof. The engaging pawl may be configured to be elastically deformable in a direction of the diameter of the supply core tube, and may be being provided with an engaging protrusion which is configured to fit in the engaging groove when the supply core tube is normally supported by the frame. The end portion of the shaft member and the connecting section being connected as the engaging protrusion may be fitted in the engaging groove, and, when the connection between the end portion of the shaft member and the connecting section is released, the engaging pawl may be elastically deformed in the direction of the diameter of the supply core tube by the tool inserted through the at least one opening and the engaging protrusion may be disengaged from the engaging groove.

According to the above configuration, the connecting section and the shaft member are connected as the engaging projection formed on the engaging pawl is fitted in the engaging groove formed on the tip portion of the shaft member. Therefore, the connection is made firmly. Further, by releasing the state where the engaging protrusion is fitted in the engaging groove, the connected state of the connecting section and the shaft member is released. Thus, the connection between the connecting section and the shaft member can be disconnected easily, and the shaft member can be separated from the supply core tube.

When the engaging protrusion is fitted in the engaging groove, the tip end of the engaging pawl may protrude toward the longitudinal center of the supply core tube with respect to the tip end of the shaft portion.

When the connecting section is engaged with the shaft member, the tip portion of the engaging pawl protrudes with respect to the tip end of the shaft member. By applying a force to the protruded portion directly or by using a tool or the like in the outward direction along the diameter of the connecting section, it is possible to disconnect the protrusion from the groove by deforming the engaging pawl. Thus, disconnecting sections using the openings can be performed easily.

The supply core tube may be formed with two of the at least one openings at positions opposing each other with an inner space of the supply core tube therebetween, and the connection mechanism may be configured such that, when the engaging pawl is elastically deformed in a direction perpendicular to a line connecting centers of the two through openings and perpendicular to the axis of the supply core tube, the engaging protrusion is disengaged from the engaging groove.

The at least one opening includes multiple (i.e., more than one) openings.

According to the above configuration, whichever openings are used, when viewed through the opening in the direction of the diameter of the core tube, the engaging pawl can be seen, and the engaging status can be released relatively easily.

The supply core tube may be made of paper. In general, the frame and/or the supply support shaft are made of material other than paper (e.g., resin, metal and the like). Therefore, if the supply core tube is made of paper, it is necessary that the supply core tube and the frame/supply side support shaft be discarded separately. Thus, the above-described configurations are particularly effective when the supply side core tube is made of paper.

According to aspects of the invention, there is provided an ink cartridge, which is provided with a frame, a supply core tube configured to supply an ink sheet rolled around the supply core tube, a supporting shaft that is connected with a longitudinal end portion of the supply core tube, the supply core tube being rotatably mounted to the frame via the supporting shaft, a connecting mechanism that connects the supporting shaft with the supply core tube, a disconnecting mechanism that is operated to disconnects the supporting shaft from the supply core tube, and at least one opening allowing a tool to be inserted therethrough to access the disconnecting mechanism for operation.

First Illustrative Embodiment

Hereinafter, referring to the accompanying drawings, a facsimile device 1 according to an illustrative embodiment of the invention will be described.

First, a configuration of the facsimile device 1, in which an ink sheet cartridge 30 provided with an exchangeable ink sheet 23 according to the first illustrative embodiment of the invention will be described.

It should be noted that, in the description hereinafter, the side of the facsimile device 1 on which an operation panel 6 is provided (i.e., the right-hand side of FIG. 1) is referred to as the front side of the facsimile device 1, and the side of the ink sheet cartridge 30 on which a take-up spool 40 is provided (i.e., the obliquely downward right-hand side of FIG. 2) is referred to as the front side of the ink sheet cartridge.

Configuration of the Facsimile Machine

FIG. 1 is a perspective view of the entire facsimile device 1. The facsimile device 1 is configured to function as a generally known facsimile machine and a printer. That is, the facsimile device 1 reads an image formed on an original 8 to obtain image data, and transmits the image data to another facsimile device as facsimile data through communication lines (e.g., telephone lines). Further, the facsimile device 1 receives facsimile data from another facsimile device through the communication lines and forms an image represented by the received facsimile data on the recording sheet 3. In addition, the facsimile device 1 receives printing data from external devices, such as a personal computer and a word processor, by wired communication (which uses, for example, a printer cable) or wireless communication (which uses, for example, infrared rays), and forms an image represented by the received printing data on the recording sheet 3.

The facsimile device 1 has a body case 4, an upper cover 5, an operation panel 6, a sheet feed tray 7, and an original stand 8. On one side of the body case 4 (in near front with respect to a plane of FIG. 1), a handset (not shown) is provided. The body case 2 has an upper opening. The upper cover 5 is positioned to cover the upper opening of the body case 4. The upper cover 5 is attached to the body case 4 to be pivotally movable in a vertical direction about a pivot axis 5*a*. The sheet feed tray 7 is positioned on the upper rear side of the body case 4. The sheet feed tray 7 holds a stack of recording sheets 3 in a slanted direction such that the leading ends of the recording sheets 3 are lower than the trailing ends of the recording sheets 3. The original stand 8 is positioned on the upper intermediate portion of the body case 4.

In the body case 4, a feed roller 9*a*, a pressure panel 9*b* to be pressed to the feed roller 9*a*, a contact type image scanner unit (CIS) 10, an original holder 11, and a pair of discharge rollers 12 are provided below the operation panel 6. The feed rollers 9 transfer the original 2 on the original stand 8 one by one toward the CIS 10. The original holder 11 is positioned above the CIS 10 to press the original 2. In the body case 4, a sheet feeding unit 16 is provided below the sheet feed tray 7. The sheet feeding unit 16 includes a sheet supply roller 13 for feeding the recording sheets 3 one by one from the sheet feed tray 7 into the facsimile device 1. The sheet feeding unit 16 further includes a separating unit 15. The separating unit 15 is pressed against an upper peripheral surface of the sheet supply roller 13 by a spring 14. The separating unit 15 is configured to fluctuate at the upper end thereof supported by the lower end thereof. A surface of the separation unit 15 facing the sheet supply roller 13 is provided with a rubber separating pad 15*a*.

Below the sheet feeding unit 16, a roller shaped platen 17, a spring 18, a heat sink 19, a thermal head 20, and an accommodating unit 22 are provided. The thermal head 20 is located on the heat sink 19 and is pressed against a lower peripheral surface of the platen 17 with expanding force of the spring 18. The accommodating unit 22 accommodates therein the ink sheet cartridge 30 in such a manner that the ink sheet cartridge 30 extends from a front side of the heat sink 19 to a rear side of the heat sink 19.

In the accommodating unit 22, the ink sheet cartridge 30 is provided such that a first supply spool 50 is positioned at the rear side of the body case 4 and a first take-up spool 40 is positioned at the front side of the body case 4. Further, a position of the first take-up spool 40 is lower than that of the first supply spool 50. That is, the ink sheet cartridge 30 is positioned in the accommodating unit 22, in a front low and rear high orientation (hip-up orientation).

In the body case 4, below the rear side portion of the ink sheet cartridge 30, a power supply circuit board 29*a* is provided. The power supply circuit board 29*a* supplies electricity to operate each part of the facsimile device 1. In front of the power supply circuit board 29*a*, a control board 29*b*, which controls various processes to operate the facsimile device 1, is arranged.

When an ink sheet 23 is fed from the first supply spool 50 to the first take-up spool 40, the ink sheet 23 passes the thermal head 20 and a top of an ink sheet separating panel 26, and then reaches a lower peripheral surface of the first take-up spool 40, while an ink surface of the ink sheet 23 facing upward. The recording sheet 3 fed from the sheet feed tray 7 overlaps with the upper surface (ink surface) of the ink sheet 23 at a printing area (i.e., between the thermal head 20 and the platen 17), so that an image is formed on the recording sheet 3. Then, the recording sheet 3 passes over an upper surface of a partitioning plate 27, which is formed above the first take-up spool 40 in the ink sheet cartridge 30 to serve as a carrier. Next, the recording sheet 3 is discharged from the body case 4 by a pair of discharge rollers 28 toward the back of the facsimile device 1.

The ink sheet 23 is bent downward at the top of the ink sheet separating panel 26, and passes below the partitioning plate 27 to be rolled by the first take-up spool 40, on the lower periphery of the first take-up spool 40.

Configuration of the Ink Sheet Cartridge

Figure 2:
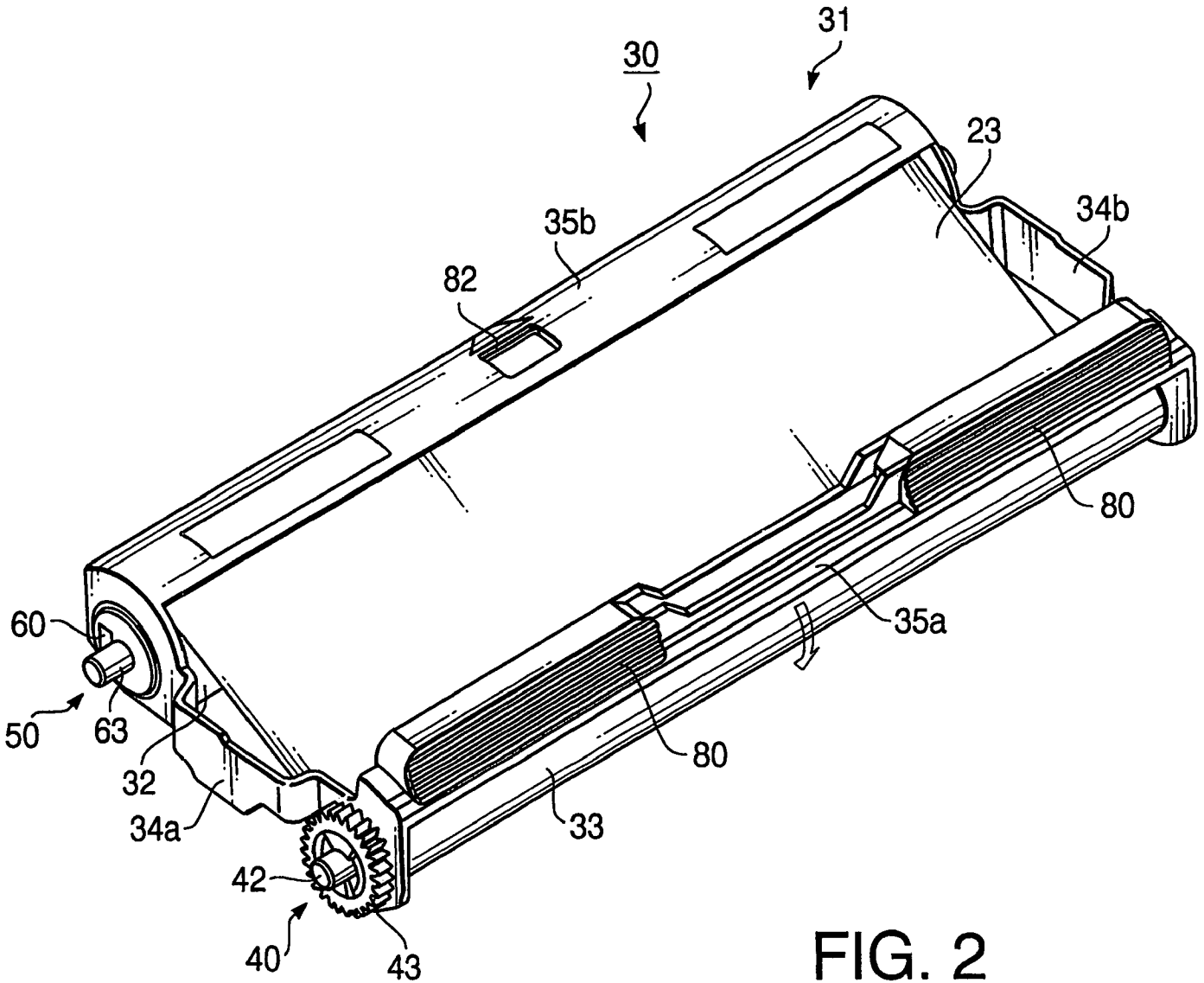
FIG. 2 is a perspective view of an ink sheet cartridge according to aspects of the invention.
Figure 3:
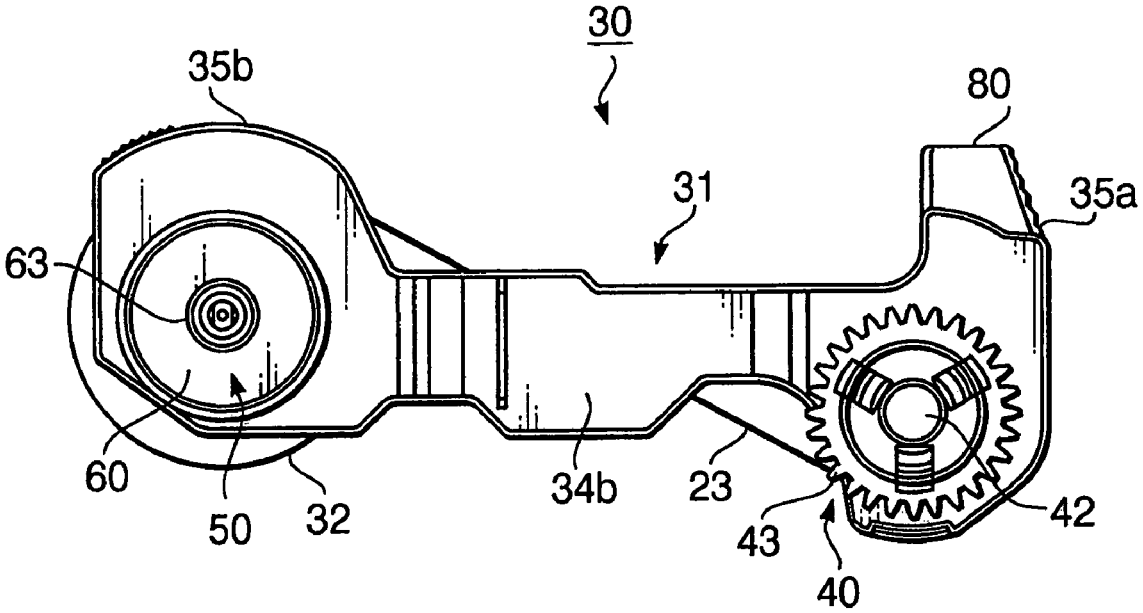
FIG. 3 is a side view of the ink sheet cartridge according to the aspects of the invention.
Figure 4:
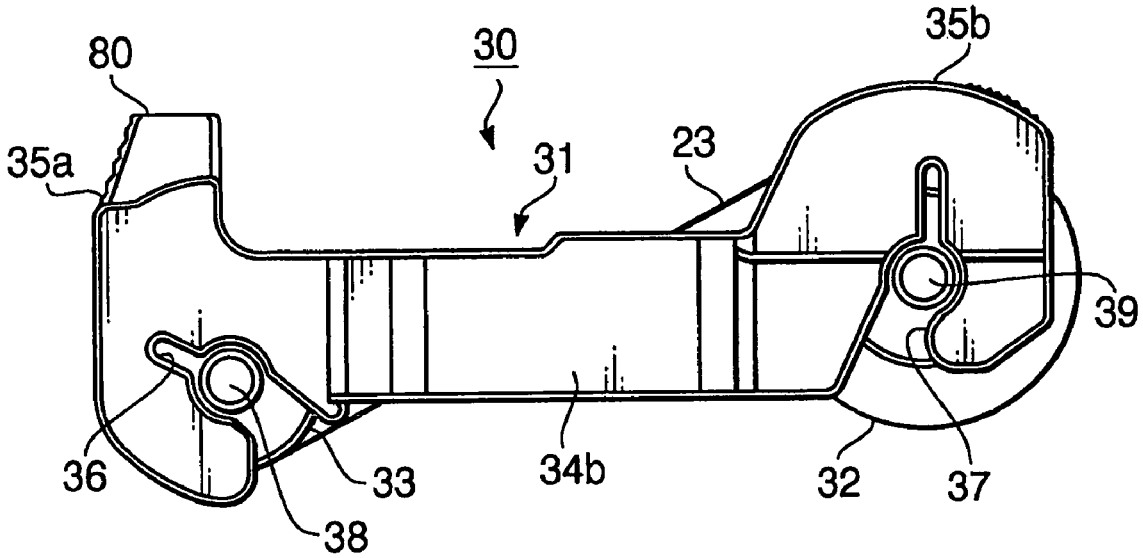
FIG. 4 is another side view of the ink sheet cartridge according to aspects of the invention.
Figure 5:
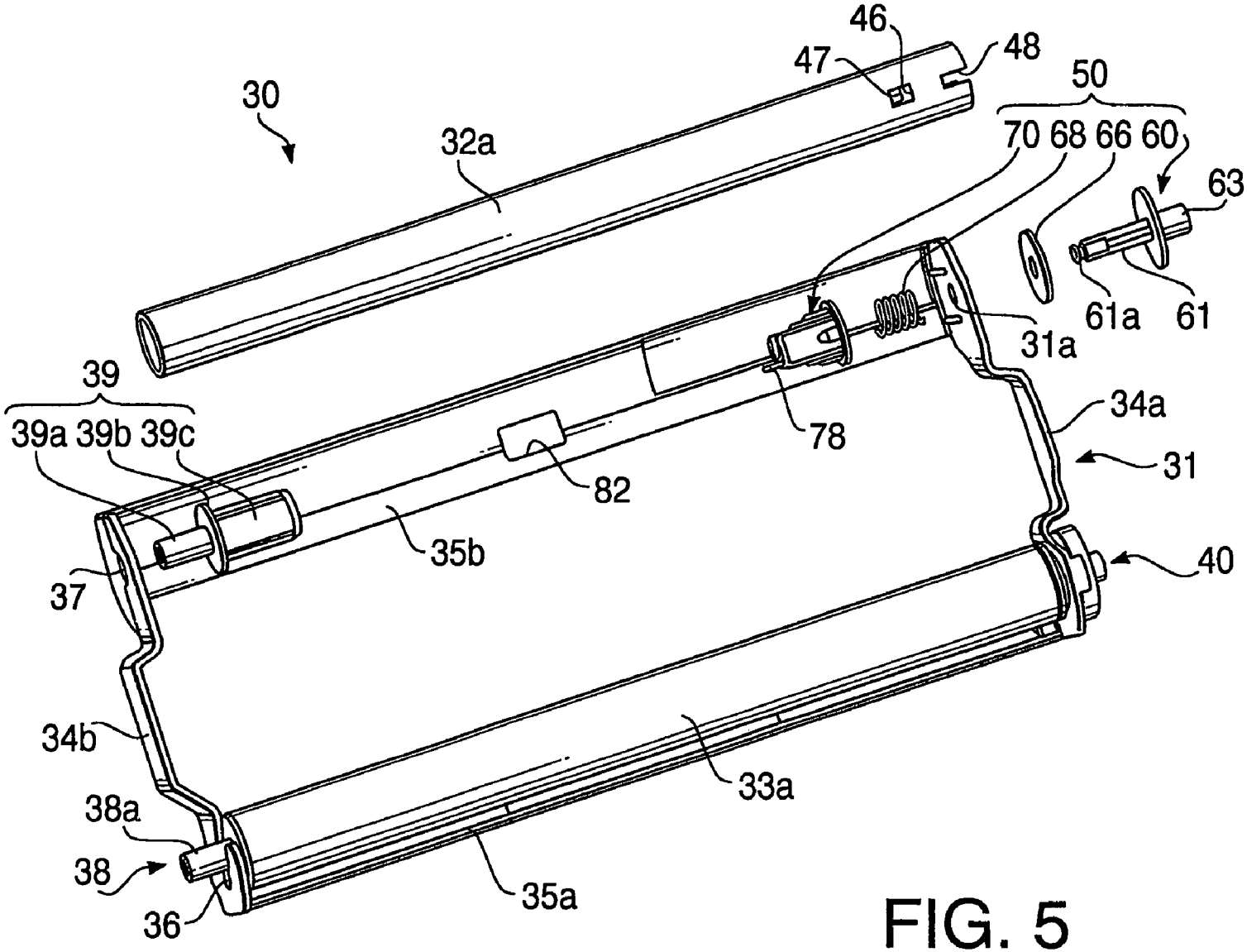
FIG. 5 is an exploded perspective view of the ink sheet cartridge view from the bottom when an ink ribbon sheet is removed according to aspects of the invention.
Figure 6:
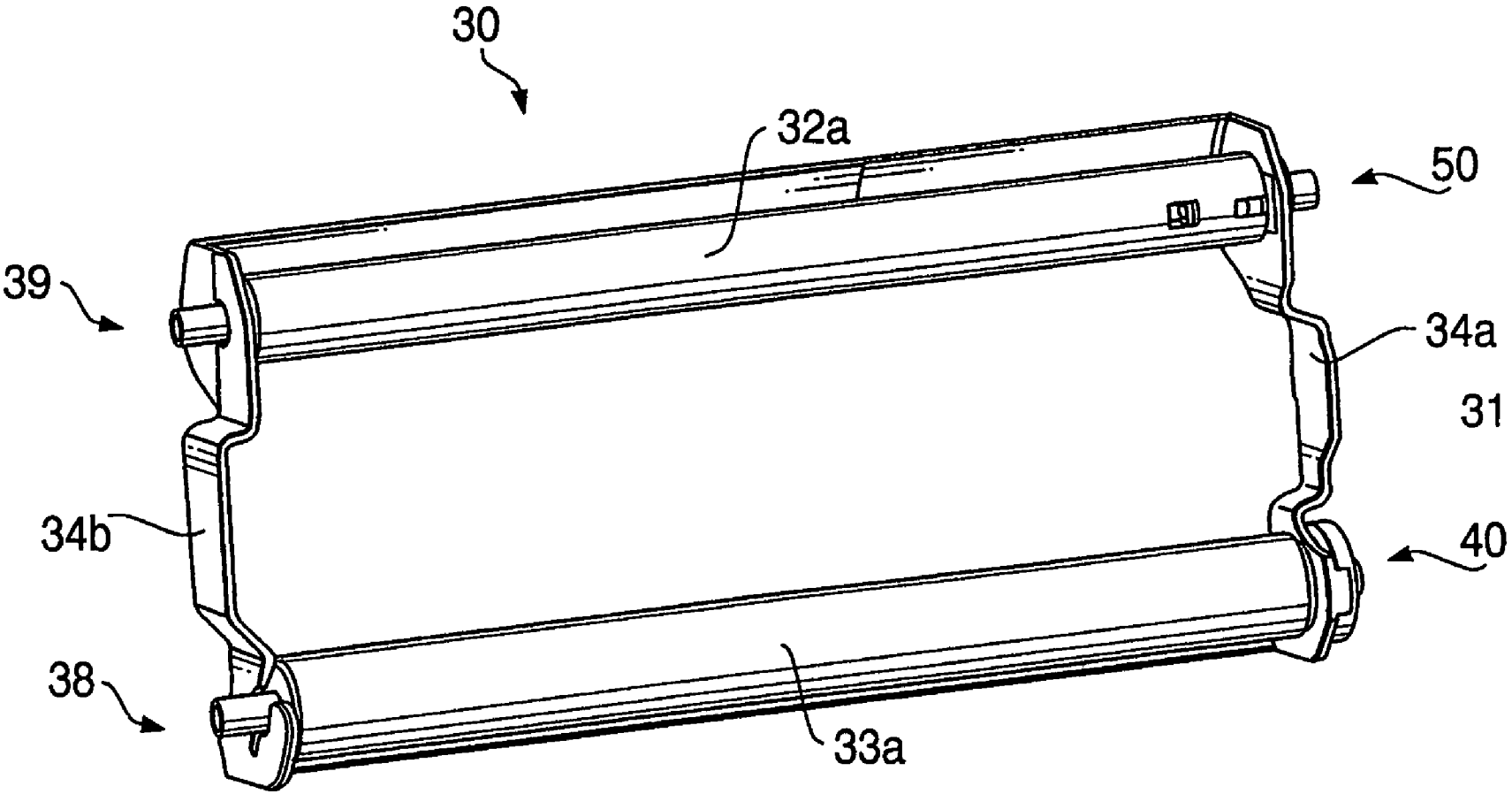
FIG. 6 is a perspective view of the ink sheet cartridge viewed from the bottom according to aspects of the invention.

Next, the configuration of the ink sheet cartridge 30 will be described in detail with reference to FIGS. 2 through 6. FIG. 2 is a perspective view of the ink sheet cartridge 30. FIG. 3 is a side view of the ink sheet cartridge 30. FIG. 4 is another side view of the ink sheet cartridge. FIGS. 5 and 6 show exploded perspective views of the ink sheet cartridge 30 view from the bottom when an ink sheet is taken out so that surfaces of a supply core tube 32*a* and a take-up core tube 33*a* are exposed.

The ink sheet cartridge 30 includes a cartridge frame 31, a supply roll 32, an ink sheet 23, and a take-up shaft 33. The cartridge frame 31 has a shape of an approximate rectangle. The supply roll 32 includes the supply core tube 32*a*, to which one end of the ink sheet 23 is rolled. The take-up shaft 33 includes the take-up core tube 33*a* to which the other end of the ink sheet 23 is rolled. The supply roll 32 and the take-up roll are rotatably supported by the cartridge frame 31. The supply roll 32, the take-up roll 33, and the ink sheet 23 are configured to be an ink sheet set. When the ink sheet 23 is exchanged, the ink sheet set including the ink sheet 23 is exchanged.

A new, unused ink sheet cartridge 30 is configured such that a new ink sheet 23 is rolled around the supply core tube 32*a* to form the supply roll 32, and no ink sheet is wound around the take-up core tube 33*a*. Once the new ink sheet set is installed in the facsimile device and an image is printed on the recording sheet 3, the ink sheet 23 is conveyed and rolled around the take-up core tube 33*a*.

The cartridge frame 31 is made of, for example, polystyrene, and is formed integrally with a pair of roll receiving walls 34*a* and 34*b* and a pair of connecting portions (i.e., a front connecting section 35*a* and a rear connecting section 35*b*). The roll receiving walls 34*a* and 34*b* are formed at positions opposite to each other. The front connecting section 35*a* connects the upper portions of the front ends of the roll receiving walls 34*a* and 34*b*, and the rear connecting section 35*b* connects the upper portions of the rear ends of the roll receiving walls 34*a* and 34*b*.

On the upper surface of the front connecting section 35*a*, a handle 80 is provided. The rear connecting section 35*b* is provided with a rectangular opening 82 at the center in the axial direction. In the opening 82, a spring holder 83 wherein a spring 14 is positioned is settled (see FIG. 1).

Shaft receiving grooves 36 and 37 are formed in the vicinity of the front end and the rear end of the side plate 34*b*, respectively, as shown in FIGS. 4 and 5. The shaft receiving groove 36 is configured to receive shaft portion 38*a* of a second take-up spool 38, which is provided at one end of the take-up core tube 33*a*, protrusively in the longitudinal direction of the take-up roll 33, so that the shaft portion 38*a* can be rotated therein. The shaft receiving groove 37 is configured to receive a shaft portion 39*a* of a second supply spool 39, which is provided at one end of the supply core tube 32*a*, protrusively in the longitudinal direction of the supply roll 32, so that the shaft portion 39*a* can be rotated therein.

The second supply spool 39 includes the shaft portion 39*a*, a disk-shaped flange 39*b*, and an inner cylindrical support 39*c* that are formed integrally and coaxially, as shown in FIG. 5. Similarly, the second take-up spool 38 includes the shaft portion 38*a*, a disk-shaped flange (not shown), and an inner cylindrical support (not shown) that are formed integrally and coaxially.

As shown in FIG. 6, the inner cylindrical support 39*c* of the second supply spool 39 is pressed in the supply core tube 32*a*, so that the second supply spool 39 rotates integrally with the supply roll 32. Also, pressed in the supply core tube 32*a* is the second take-up spool 38, which rotates integrally with the take-up roll 33. The second take-up spool 38 and the second supply spool 39 have the same shape and can be replaced with each other.

On the other roll receiving wall 34*a*, at a position corresponding to the shaft receiving groove 36, a first supply spool 40 is rotatably held. The first take-up spool 40 is inserted in the other side (i.e., the left-hand side in FIG. 2, and right-hand side in FIGS. 5 and 6) of the take-up core tube 33*a* of the take-up roll 33. The first take-up spool 40 rotates integrally with the take-up roll 33.

As shown in FIG. 2, an input gear 43 is securely fitted on a protruded portion 42 of the take-up first spool 40, which protrudes sideward from the other roll receiving wall 34*a*. The input gear 43 engages with output gear (not shown) for transmitting a driving force of a driving motor (not shown) provided to the body case 4 of the facsimile device 1 when the ink sheet cartridge 30 is attached to the body case 4. Thus, when the ink sheet cartridge 30 is attached to the body case 4, the take-up roll 33 supported by the take-up first spool 40 and the second take-up spool 38 is rotated by the driving force of the driving motor, and the ink sheet 23 rolled around the supply roll 32 is taken up.

Figure 7A:
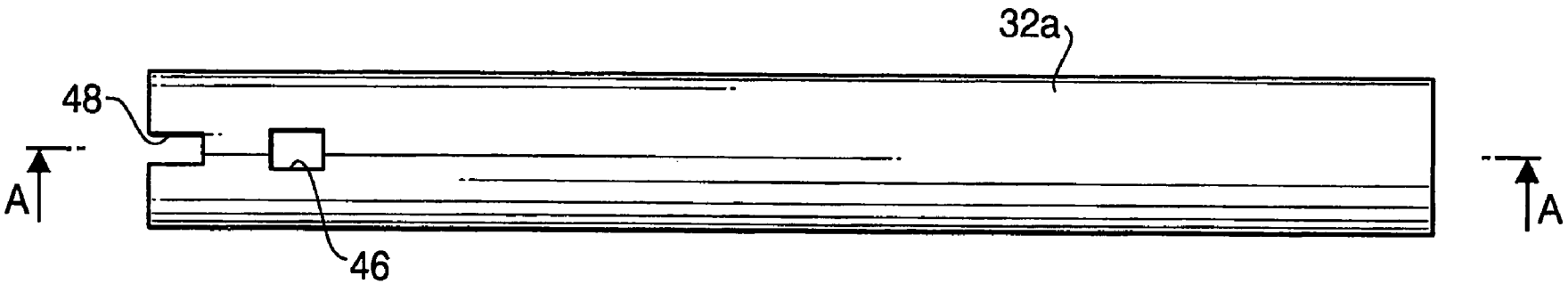
FIG. 7A is a plan view of a supplying core tube according to aspects of the invention.
Figure 7B:
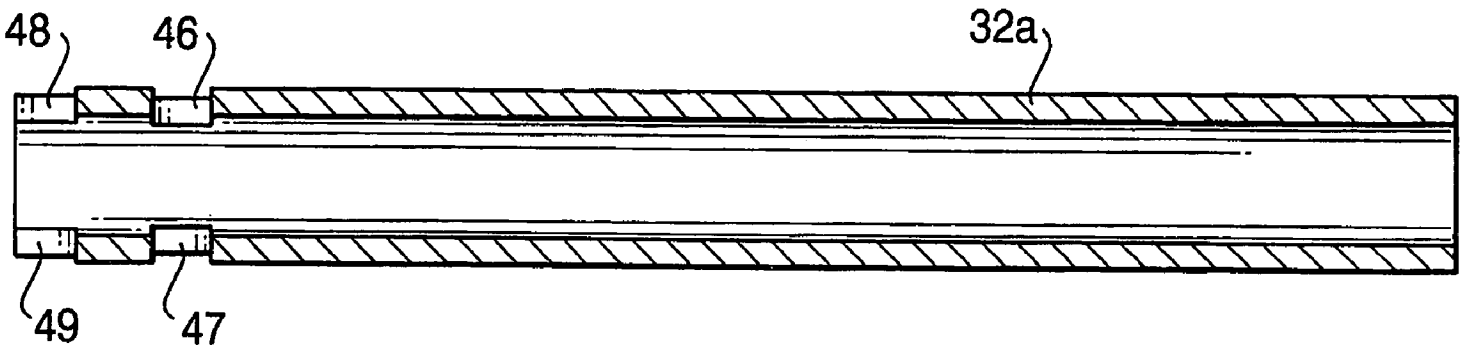
FIG. 7B is a cross sectional view of the supplying core tube taken along line A-A of FIG. 7A.

Next, the configuration of the supply core tube 32*a* will be described referring to FIGS. 5, 7A and 7B. FIG. 7A is a plan view of the supply core tube 32*a* and FIG. 7B is a cross sectional view thereof taken along line A-A in FIG. 7A. According to this illustrative embodiment, the supply core tube 32*a* is made of paper, and formed to be a hollow cylinder with both side ends being opened. On one side portion of the supply core tube 32*a*, a pair of fixing grooves 48 and 49 is formed with each groove formed opposite to the other with respect to the central axis of the hollow cylinder. Further, at the end portion, two through openings 46 and 47 are formed opposite to each other with respect to the central axis of the hollow cylinder.

As will be described later, in the fixing grooves 48 and 49, stopper protrusions 74 and 75 of a core tube fixing member 70 are inserted so that the supply core tube 32*a* and the core tube fixing member 70 rotate integrally.

The through openings 46 and 47 are used for removing the cartridge frame 31 from the supply core tube 32*a* when the ink sheet 23 is used up and the circumferential surface of the supply core tube 32*a* is exposed to the outside (i.e., then the ink sheet cartridge 30 is to be discarded). Specifically, when the ink sheet cartridge 30 is to be discarded, a rod-like member such as a screwdriver is inserted in the through openings and a predetermined operation is performed (which will be described later).

Configuration of First Supply Spool

At a portion of the other roll receiving wall 34*a*, opposite to the shaft receiving groove 37, the first supply spool 50 to be inserted in the other side (i.e., left-hand side in FIG. 2; right-hand side in FIGS. 5 and 6) of the supply core tube 32*a* of the supply roll 32 is rotatably supported (see FIGS. 4 and 6). The first supply spool 50 is provided with, as shown in FIG. 5, a core tube fixing member 70 to be inserted in the other side of the supply core tube 32*a*, a compression spring 68 to be inserted in the core tube fixing member 70, felt 66 and a rotationally supporting member 60. Specifically, the core tube fixing member 70 and the compression spring 68 are arranged on the inner surface side of the other roll receiving wall 34*a*, while the felt 66 and the rotationally supporting member 60 are arranged on the outer surface side of the roll receiving wall 34*a*.

Figure 11:
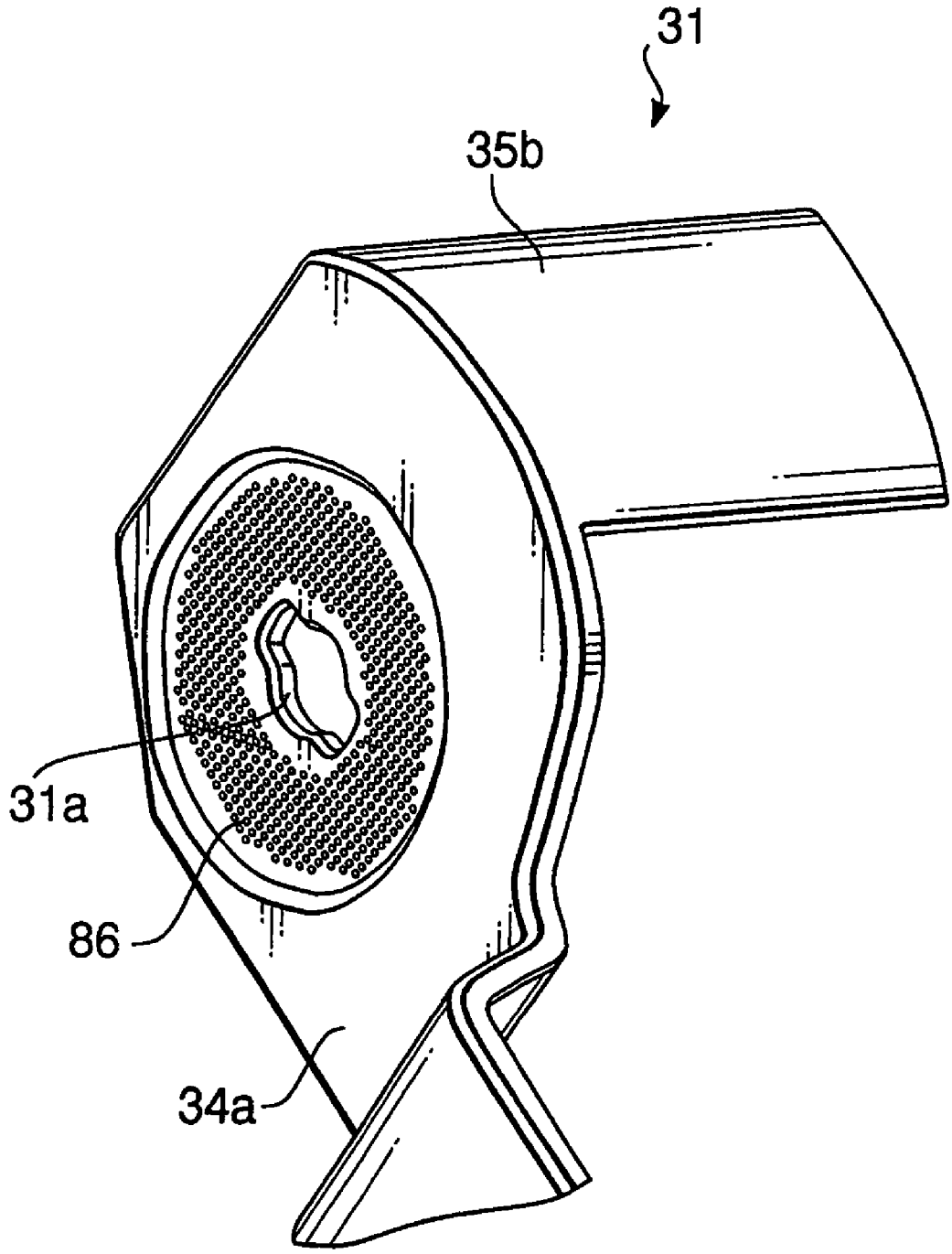
FIG. 11 is a perspective view of the cartridge frame at a portion where a bearing opening in which the rotary supporting member is inserted is formed according to aspects of the invention.

More specifically, as shown in FIG. 5, an inserting shaft 61 of the rotationally supporting member 60 is inserted through a central hole of the felt 66, a receiving hole 31*a* formed on the roll receiving wall 34*a* (see FIG. 11), an inner space of the compression spring 68, and the inside of the core tube fixing member 70. Then, an engaging protrusion 79 (see FIGS. 9A, 9D and 9E) formed on an engaging pawl 78 of the fixing member 70 is fitted in an engaging groove 61*a* formed at a tip end of the insertion shaft 61. With the above structure, the first supply spool 50 is integrally formed.

Figure 12A:
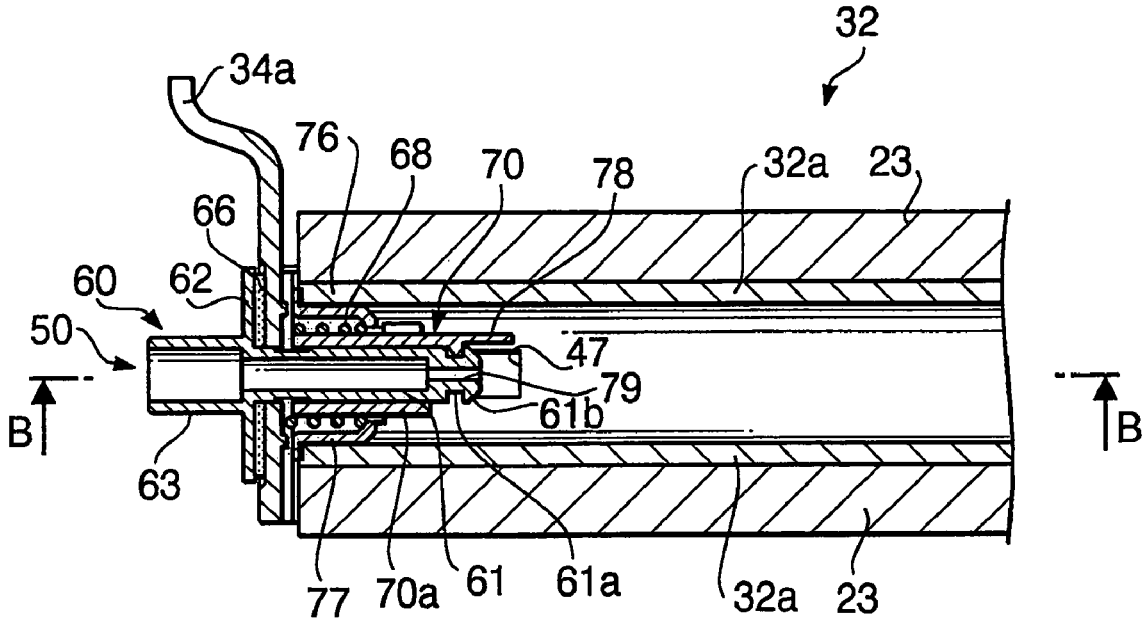
FIG. 12A is a cross sectional view of the supplying ribbon shaft mounted on the cartridge frame according to aspects of the invention.
Figure 12B:
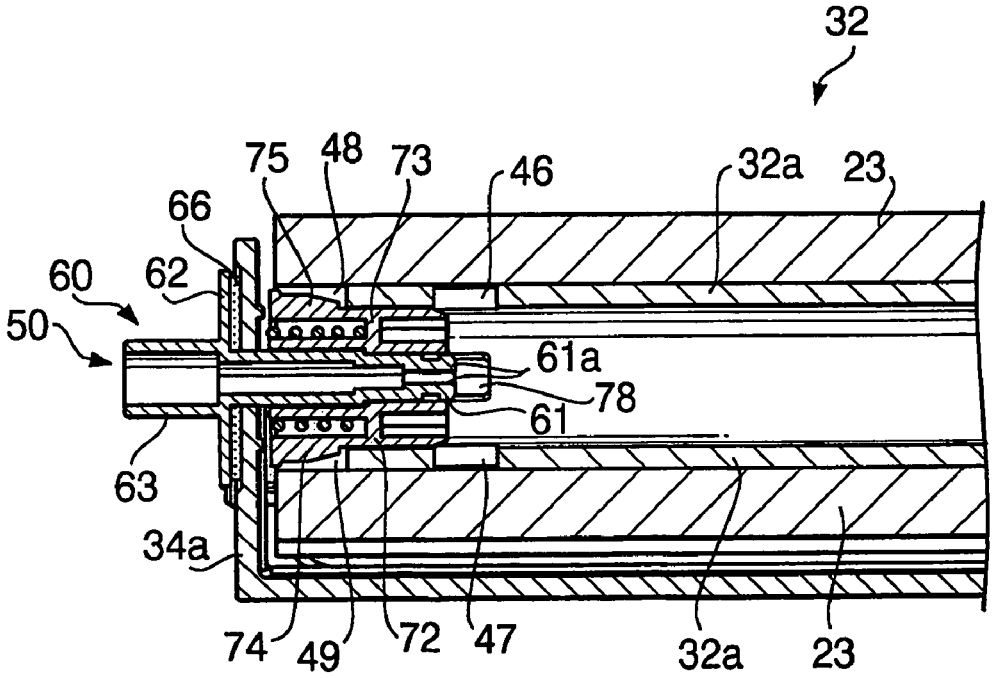
FIG. 12B is a cross sectional view of the supplying ribbon shaft taken along line B-B shown in FIG. 12A.

FIGS. 12A and 12B show cross sectional views illustrating a condition where an end of the supply core tube 32*a* is normally supported by the roll receiving wall 34*a*. Specifically, FIG. 12A shows a condition where the supply roll 32 is mounted onto the cartridge frame 31, and FIG. 12B is a cross sectional view take along line B-B of FIG. 12A.

(a) Rotationally Supporting Member

Figure 8:
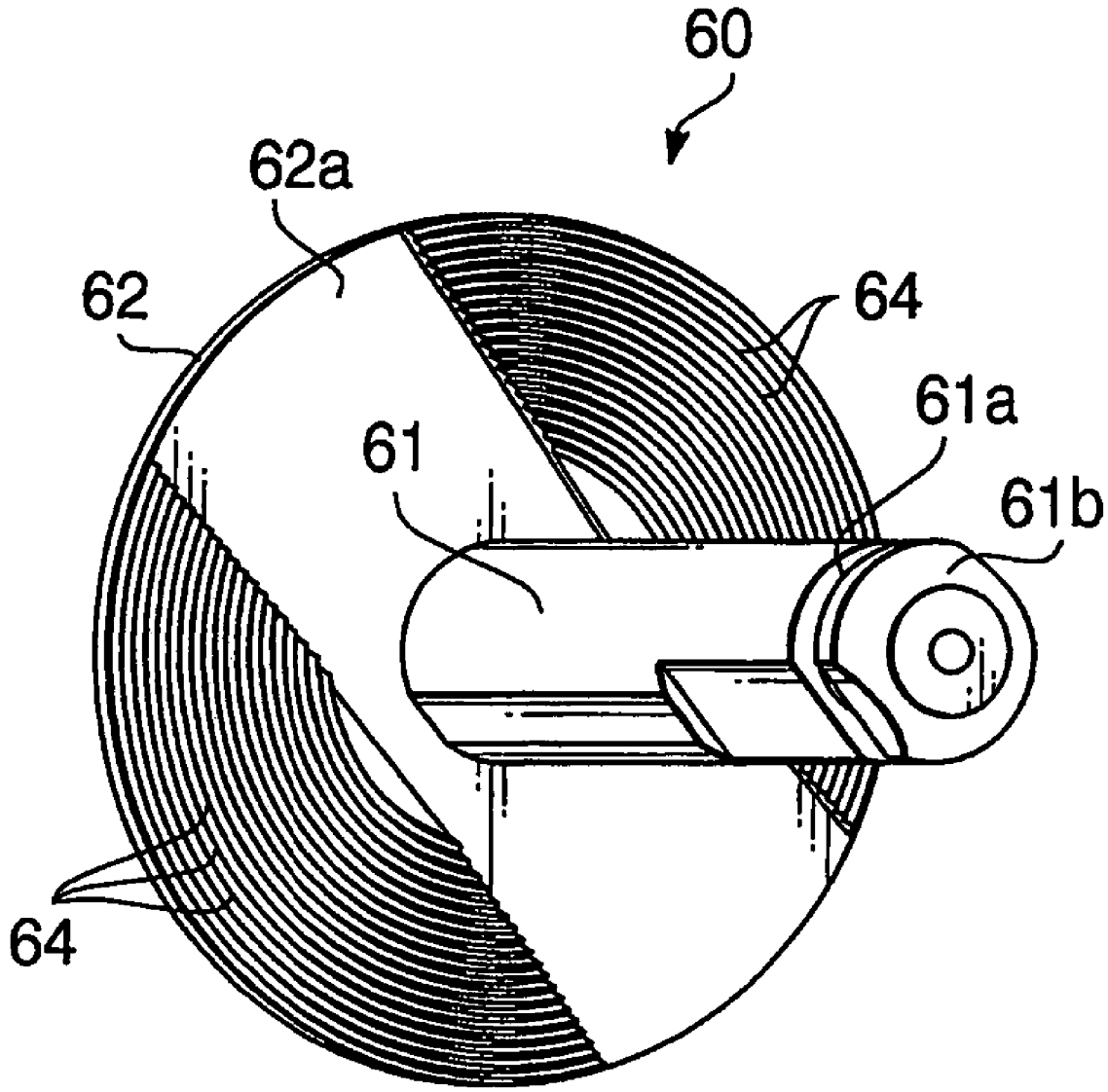
FIG. 8 is a perspective view of a rotary supporting member constituting a supplying side first spool according to aspects of the invention.

As shown in FIGS. 8, 12A and 12B, the rotationally supporting member 60 is configured such that a disk portion (flange portion) 62, an insertion shaft 61 protruded from the center of the disk portion 62, an outer tube 63 protruded from the disk portion 62 in a direction opposite to the protruded direction of the insertion shaft 61 (see FIGS. 5, 12A and 12B) are integrally formed. Inside the outer tube 63, a shaft projected from a body side frame (not shown) is fitted in when the ink sheet cartridge 30 is accommodated in an accommodating unit 22 of the facsimile device 1. The rotationally supporting member 60 may be formed of POM (polyacetal) which is resin material harder than PS (polystyrene) that is used for the cartridge frame 31.

The rotationally supporting member 60 is configured such that the insertion shaft 61 is inserted in the shaft receiving hole 31*a* (see FIGS. 5 and 11) penetrated through the shaft receiving wall 34*a*, and further, the tip of the rotationally supporting member 60 is inserted in the core tube fixing member 70. On the outer circumferential surface of the tip portion of the insertion shaft 61, an engaging groove 61*a* is formed along the circumferential direction. The insertion shaft 61 is formed to have a tapered surface 61*b* such that a portion closer to the tip end has a smaller diameter.

(b) Core Tube Fixing Member and Compression Spring

Figure 9A:
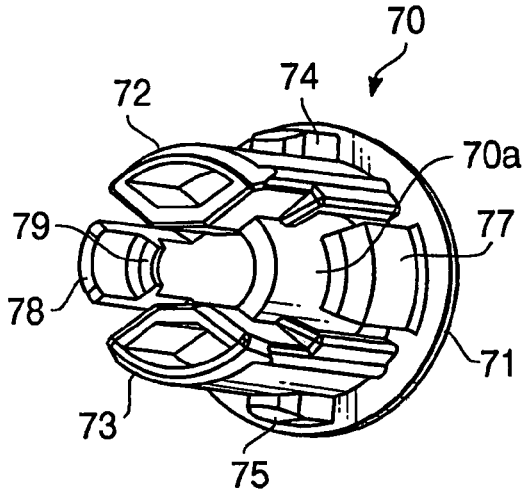
FIGS. 9A and 9B are perspective views of a core mounting member constituting the supplying side first spool according to aspects of the invention.
Figure 9B:
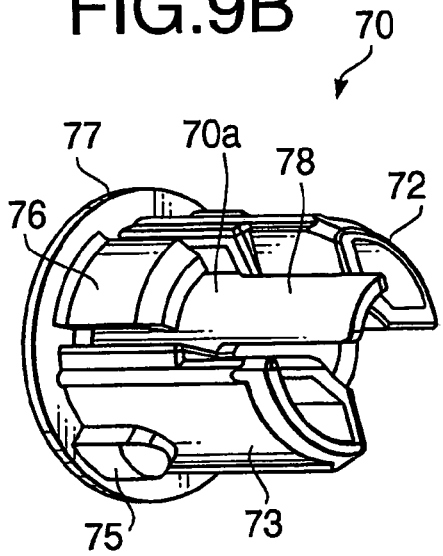
Figure 9C:
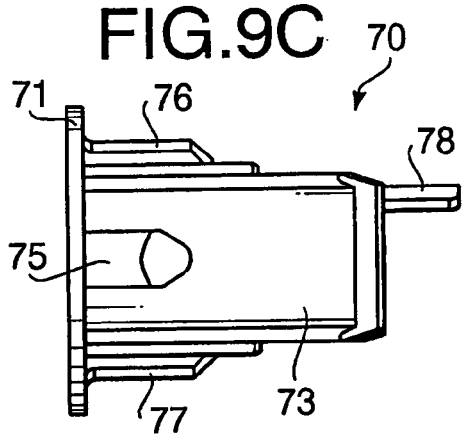
FIG. 9C is a front view of a core mounting member according to aspects of the invention.
Figure 9D:
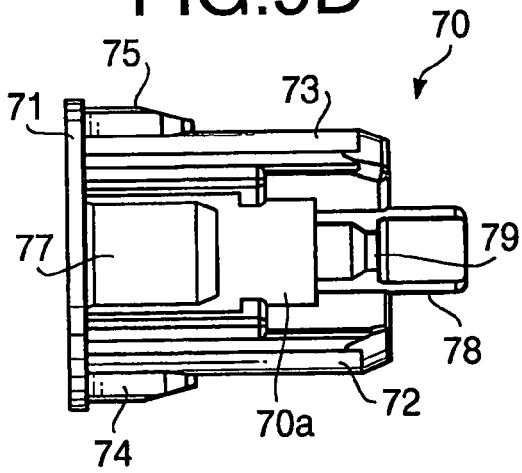
FIG. 9D is a bottom view of a core mounting member according to aspects of the invention.
Figure 9E:
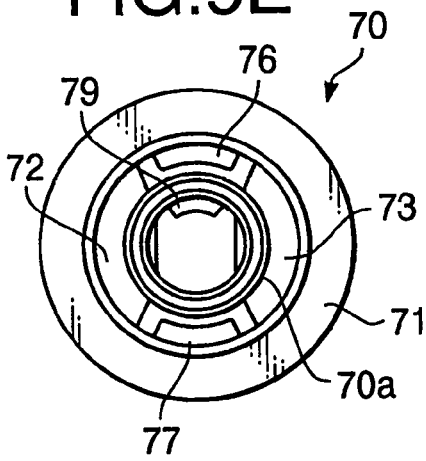
FIG. 9E is a side view of a core mounting member according to aspects of the invention.

A structure of the core tube fixing member 70 will be described with reference to FIGS. 9A-9E and 12A-12B. FIGS. 9A and 9B are perspective views, FIG. 9C is a front view, FIG. 9D is a bottom view in which the core tube fixing member 70 shown in FIG. 9C is viewed from the bottom, and FIG. 9E is a side view in which the core tube fixing member 70 shown in FIG. 9C is viewed from the left-hand side thereof.

The core tube fixing member 70 is integrally formed of resin. As shown in FIGS. 9A-9E, the core tube fixing member 70 has an annular portion 71 formed on the proximal end thereof, a pair of insertion supporting sections 72 and 73 protruded from the annular portion 71 along the central axis of the core tube fixing member 70, and opposing to each other, and a pair of hooks 76 and 77 which are also protruded from the annular portion 71 along the central axis and oppose each other.

The outer surfaces of the insertion supporting sections 72 and 73 (i.e., the surfaces facing the inner surface of the supply core tube 32*a* when inserted therein) are formed to have cylindrical surfaces, respectively, so that they contact the inner surface of the supply core tube 32*a* when inserted therein. It should be noted that the annular portion 71 is configured to have the same radius as that of the outer surface of the supply core tube 32*a*.

Further, the outer surfaces of the two insertion supporting sections 72 and 73, stopper projections 74 and 75 are provided to protrude outward in a radial direction, respectively. The supply core tube 32*a* is configured such that, at the end portion that receives the core tube fixing member 70, two fixing grooves 48 and 49 are formed, as shown in FIGS. 7A and 7B, which oppose each other and extend in the axial direction. When the core tube fixing member 70 is inserted in the supply core tube 32*a*, the stopper protrusions 74 and 75 are inserted in the fixing grooves 48 and 49, respectively. With this structure, the core tube fixing member 70 is fixed relative to the supply core tube 32*a*, and both of them can rotate integrally.

Further to the above, an inner tube 70*a*, which is coaxial with the annular portion 71, is formed such that it is supported by the inner surfaces of the pair of insertion supporting sections 72 and 73. The insertion shaft 61 of the rotationally supporting member 60 is to be inserted inside the inner tube 70*a* as shown in FIG. 12A.

At a portion on the tip end of the inner tube 70*a*, a plate-like engaging pawl 78 is extended as shown in FIGS. 9C and 12A. The engaging pawl 78 is configured to elastically deform in the inner direction (i.e., in a direction of the inner radius of the supply core tube 32*a*). On the inner surface (i.e., a surface facing the central axis of the supply core tube 32*a*), an engaging protrusion 79 is formed to protrude in the inner direction (see FIG. 12A). The engaging protrusion 79 is fitted in an engaging groove 61*a* formed at a tip end portion of the rotationally supporting member 60. With this engagement, the supply roll 32 is securely supported with respect to the cartridge frame 31.

FIGS. 12A and 12B show a condition where the core tube fixing member 70 is engaged with (fitted in) the engaging groove 61*a* of the rotationally supporting member 60. In this condition, with the engagement therebetween, the rotationally supporting member 60 and the core tube fixing member 70 are securely connected. Therefore, withdrawal of the rotationally supporting member 60 from the core tube fixing member 70 (toward the left-hand side in FIGS. 12A and 12B) can be prevented. Further, the first supply spool 50 is securely supported by the roll receiving wall 34*a*.

As shown in FIG. 9E, between the inner tube 70*a* and the annular portion 71, a cylindrical clearance is formed, and a cylindrical member can be inserted in this clearance. According to this illustrative embodiment, the compression spring 68 is inserted in the clearance, a tip end of the compression spring 68 being hooked on the tip portions of the pair of hooks 76 and 77, thereby fixing the compression spring 68 to the core tube fixing member 70. That is, into the clearance defined between the outer surface of the inner tube 70*a* and the hooks 76 and 77, the compression spring 68 is inserted so as to cover the entire circumferential surface of the inner tube 70*a* (see FIG. 12A).

Figure 10A:
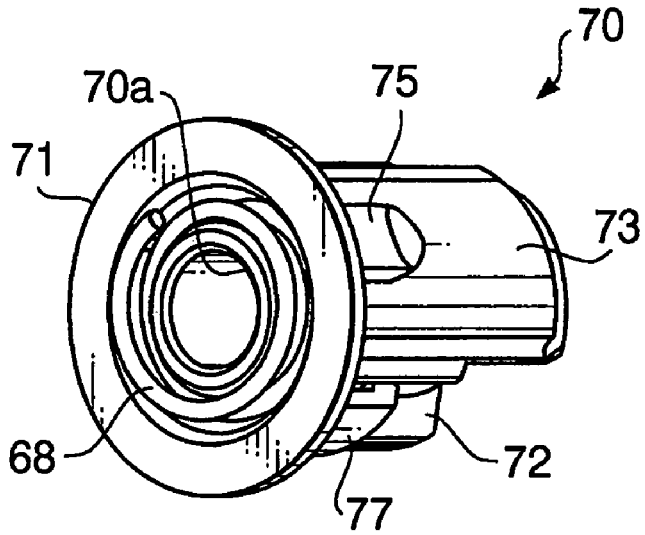
FIGS. 10A and 10B show perspective views of the core mounting member attached with a torsion spring according to aspects of the invention.
Figure 10B:
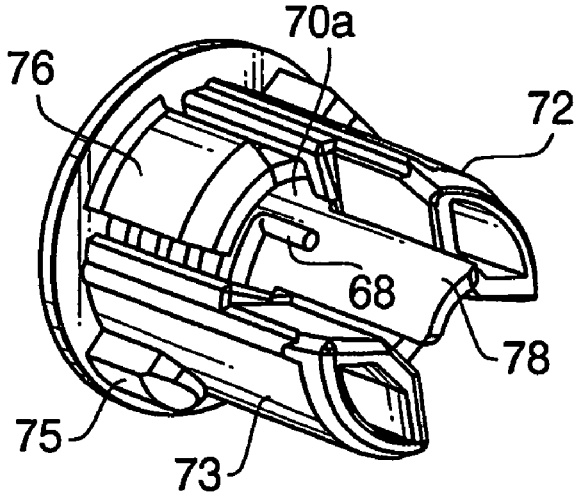

FIGS. 10A and 10B show perspective views of the core tube fixing member 70 in which the compression spring 68 is inserted therein. As shown in FIG. 10A, the compression spring 68 inserted from the proximal end side of the core tube fixing member 70 does not completely enter the core tube fixing member 70, and an end portion of the compression spring is slightly protruded from the proximal end of the core tube fixing member 70 in a neutral state. FIG. 10B shows a state where the end of the compression spring 68 is suspended by the tip of the hook 76, and the compression spring 68 is fixed to the core tube fixing member 70. It should be noted that, although the compression spring 68 is fixed by the hooks 76 and 77 as described above, if pulled with a force greater than a predetermined amount, the hooks 76 and 77 elastically deform and allow the compression spring 68 to be withdrawn from the core tube fixing member 70. That is, when the ink sheet cartridge 30 is in use, the compression spring 68 is fixed in the core tube fixing member 70, while after use, the compression spring 68 can be removed from the core tube fixing member 70 so that the core tube fixing member 70 and the compression spring 68 can be discarded separately.

With the above configuration, when the insertion shaft 61 of the rotationally supporting member 60 is inserted inside the inner tube 70*a* of the core tube fixing member 70 from the proximal end side, the tip end portion of the insertion shaft 61 contacts the engaging protrusion 79 formed on the engaging pawl 78 of the core tube fixing member 70. Since the tip portion of the insertion shaft 61 is formed to have the tapered surface 61*b*, as the insertion shaft 61 is inserted, the engaging pawl 78 elastically deforms.

If the insertion shaft 61 is inserted further, the engagement protrusion 79 is fitted in the engaging groove 61*a*, and the engaging pawl 78 elastically deformed restores its original shape (see FIGS. 12A and 12B). At this stage, the core tube fixing member 70 receives the force to separate the core tube fixing member 70 from the inner surface of the roll receiving wall 34*a* by the repulsing force of the compression spring 68, and by the force, the disk portion 62 of the rotationally supporting member 60, which is connected with the core tube fixing member 70, is pressed onto the outer surface of the roll receiving wall 34*a*.

Further, the engaging pawl 78 is formed such that the tip end of the engaging pawl 78 extends over the tip end of the insertion shaft 61, and protrudes toward the center of the supply core tube 32*a* when the engaging protrusion 79 is fitted in the engaging groove 61*a* (see FIGS. 12A and 12B).

On the outer surface of the roll receiving wall 34*a*, at an area that faces the disk portion 62 of the rotationally supporting member 60, tapered protrusions 86 are arranged over the entire surface of the area. On the opposing surface 62*a* of the disk portion 62, as shown in FIG. 8, coaxial annular grooves 64 are formed around the insertion shaft 61. Specifically, on the opposing surface 62*a* having a circular shape, the annular grooves are formed only on a pair of semicircular areas which are arranged on both sides of a predetermined rectangular area passing the center of the circular surface 62*a*. The felt 66 is formed to have an annular shape corresponding to the shape of the disk portion 62. The felt 66 is sandwiched between the outer surface of the roll receiving wall 34*a* and the disk portion 62 of the rotationally supporting member 60 while being pressed by the force of the compression spring 68.

(c) Effects

By the first supply spool 50 that is configured such that the rotationally supporting member 60, the felt 66, the compression spring 68 and the core tube fixing member 70 are integrally assembled, the supply roll 32 is supported by the roll receiving wall 34*a* (i.e., the cartridge frame 31), as shown in FIGS. 12A and 12B.

As the take-up roll 33 starts rotating by the driving force generated by the driving motor, the supply roll 32 rotates. Further, at the same time, the core tube fixing member 70 and the rotationally supporting member 60 of the first supply spool 50 rotate integrally. At this stage, the felt receives the pressing force by the outer surface of the roll receiving wall

34*a* and the disk portion 62 of the rotationally supporting member 60, which are opposed with each other. On the surface of the felt 66 contacting the outer surface of the roll receiving wall 34*a*, the tapered protrusions 86 (see FIG. 11) formed on the outer surface of the roll receiving wall 34*a* protrude into the felt 66, and a relatively strong frictional force is generated therebetween. On the other hand, the other surface of the felt 66 contacts the surface 62*a* of the disk portion 62 of the rotationally supporting member 60. Since annular grooves 64 (see FIG. 8) are formed on the surface 62*a* of the disk portion 62, a frictional force that is weaker than that caused by the tapered protrusions 86 is generated between the felt 66 and the surface 62*a*. With the above configuration, the felt 66 will not be driven by the rotationally supporting member 60, but will be substantially fixed on the outer surface of the cartridge frame 31. In addition, the felt 66 contacts the surface 62*a* of the rotationally supporting member 60 at a constant and weak frictional force, which provides a stable back tension (a resistant force to rotation) to the rotation of the supply roll 32.

(d) Decomposition of Ink Sheet Cartridge for Exchange

When the ink sheet 23 is used up and the ink sheet cartridge 30 is to be discarded, a user decomposes the first supply spool 50 using the two through openings 46 and 47 formed on the supply core tube 32*a*.

As shown in FIGS. 12A and 12B, a portion where the engaging protrusion 79 formed on the engaging pawl 78 is fitted in the engaging groove 61*a* of the insertion shaft 61, and a portion from the engaging portion to the tip of the engaging pawl 78 can be seen from outside the supply core tube 32*a* through the two through openings 46 and 47.

Further, a positional relationship among the engaging pawl 78 and the two through openings 46 and 47 is designed such that a direction in which the engaging pawl 78 can elastically deform is perpendicular to a line connecting the centers of the two through openings 46 and 47, and perpendicular to the axis of the supply core tube 32*a*. Therefore, by inserting a rod-like tool through the opening 46 or 47 and elastically deforming the engaging pawl 78, the engagement between the engaging protrusion 79 and the engaging groove 61*a* can be disconnected.

As the engaging protrusion 79 is disengaged from the engaging groove 61*a*, the user can withdraw the rotationally supporting member 60 from the core tube fixing member 70, and further withdraw the roll receiving hole 31*a* of the roll receiving wall 34*a*. Then, the core tube fixing member 70 can be freed from the roll receiving wall 34*a*. As a result, for example in FIG. 12B, the core tube fixing member 70 can be moved, together with the supply core tube 32*a*, in the upper direction on the figure. Then, the core tube fixing member 70 can be removed from the supply core tube 32*a*, and further, the compression spring 68 can be withdrawn from the core tube fixing member 70. As above, the first supply spool 50 can be disassembled into individual components, and the supply core tube 32*a* can be withdrawn from the cartridge frame 31.

According to the illustrative embodiment described above, since the engaging protrusion 79 of the engaging pawl 78 of the core tube fixing member 70 fitted in the engaging groove 61*a* formed at the tip portion of the insertion shaft 61 of the rotationally supporting member 60, the core tube fixing member 70 and the rotationally supporting member 60 are connected firmly. Further, the supply core tube 32*a* can be supported by the cartridge frame 31 firmly.

Further, by disengaging the engaging protrusion 79 from the engaging groove 61*a*, the engagement between the core tube fixing member 70 and the rotationally supporting member 60 can be released easily. Therefore, the rotationally supporting member 60 can be disconnected from the supply core tube 32*a*. Further, the supply core tube 32*a* can be disconnected from the cartridge frame 31 easily, and the supply core tube 32*a* can be disconnected from the core tube fixing member 70 easily.

It should be noted that, by the elastic force of the compression spring 68, stable back tension (rotationally resistant force) can be applied to the rotating of supply roll 32. Therefore, the ink sheet 23 can be prevented from sagging.

Further, in the illustrative embodiment, the felt 66 is interposed between the outer surface of the roll receiving wall 34*a* and the disk portion 62 of the rotationally supporting member 60, and the protrusions 86 formed on the outer surface of the roll receiving wall 34*a* protrude into the felt 66. Therefore, sufficient back tension can be generated stably.

The compression spring 68 is fixed by the hooks 76 and 77 provided to the core tube fixing member 70. If the user attempts to withdraw the compression spring 68 with a force greater than a predetermined force, each of the hooks 76 and 77 elastically deforms by the force, thereby allowing the user to withdraw the compression spring 68 without damaging the compression spring 68 or hooks 76 and 77. With such a configuration, when the core tube fixing member 70 is in use or is disconnected from the rotationally supporting member 60, the compression spring 68 stays securely fixed to the core tube fixing member 70, and will not spring out from the core tube fixing member 70 with the elastic force generated by itself. On the other hand, after the core tube fixing member 70 has been disconnected from the rotationally supporting member 60, the compression spring 68 can be removed from the core tube fixing member 70 easily, and can be discarded separately from the other members.

Further, when the core tube fixing member 70 is attached to the supply core tube 32*a*, the stopper projections 74 and 75 formed on the core tube fixing member 70 are inserted in the fixing grooves 48 and 49 of the supply core tube 32*a*. Therefore, the position of the core tube fixing member 70 with respect to the supply core tube 32*a* can be adjusted exactly. With this configuration, therefore, the positional relationship between the through openings 46, 47 and the connection structure (i.e., a portion where the engaging protrusion 79 engages with the engaging groove 61*a*) can be securely fixed, and it is ensured that the connection/disconnection can be done correctly.

It should be noted that the above-described configuration is only an illustrative embodiment, and the invention need not be limited to the above configuration, but can be modified in various ways without departing from aspects of the invention.

For example, in the above-described illustrative embodiment, two through openings 46 and 47 are formed on the supply core tube 32*a*, and the user can insert a rod-like tool through either one of the through openings 46 and 47 to disengage the engaging protrusion 79 from the engaging groove 61*a*. It should be noted that the number of such through openings need not be limited to "two" but can be one or more than two. It should be noted that, if there is only one through opening, it may be difficult for the user to view the engaged portion when the rod-like tool is inserted through the opening since, for example, sufficient light does not enter the supply core tube. In such a case, it is preferable that additional openings are formed.

It should be appreciated that all the through openings need not be configured for disengaging the engaged portion (i.e., for allowing the rod-like tool to be inserted). That is, only one through hole may be used for inserting the rod-like tool, and the other through hole(s) may be used for introducing light inside the supply core tube 32*a*. For example, if the above-described illustrative embodiment is modified such that the first supply spool 50 is arranged such that the engaging protrusion 79 faces the through opening 46, only one (i.e., the opening 46) of the through openings 46 and 47 is used for releasing the engagement, and the other can be used only for introducing light inside the supply core tube 32*a*.

It should be noted that the through openings 46 and 47 may be configured as small as possible. It is because, if the through openings are relatively large in size, the shape of the through openings may be imprinted on the ink sheet rolled around the supply core tube 32*a*. Such imprinting deteriorates the quality of the ink sheet 23, and may have a bad effect on images printed on a recording sheet 3 using such an ink sheet 23.

In the above-described illustrative embodiment, the rotationally supporting member 60 and the core tube fixing member 70 are connected with the engagement between the engaging groove 61*a* and the engaging protrusion 79. It should be appreciated that this configuration is only an illustrative example, and any structure which allows secure connection between the core tube fixing member 70 and the rotationally supporting member 60, and easy disengagement through at least one of the through openings 46 and 47 would be appropriate. For example, opposite to the illustrative embodiment, a groove may be formed on the insertion shaft 61 of the rotationally supporting member 60 and an engaging protrusion may be provided to the engaging pawl 78.

In the illustrative embodiment described above, the engaging pawl 78 is formed to extend from the inner tube 70*a* toward the tip of the core tube fixing member 70. It should be appreciated that such a structure is only an example, and any position and/or any shape of the engaging pawl 78 can be employed as far as the engaging protrusion 79 can be inserted in the engaging groove 61*a*. For example, the engaging pawl may be formed to extend from the annular portion 71, or one of the insertion supporting sections 72 and 73 may be formed shorter and the engaging pawl may be formed on the tip of the shorter insertion supporting member.

In the illustrative embodiment, the compression spring 68 is fixed in the core tube fixing member 70 by suspending the tip end portion of the compression spring 68 onto the hooks 76 and 77 formed on the core tube fixing member 70. It should be appreciated that such a configuration is only an example of possible structures, and different structures can be employed. For example, the compression spring 68 may be secured to the core tube fixing member 70 with adhesive agent or by welding. When the alternative securing method is used, it is preferable that the user can remove the compression spring 68 from the core tube fixing member 70 easily.

Although the illustrative embodiment is described with reference to the facsimile device, the invention can be applied to various devices including a printer, a copier and an MFP (Multi-Function Peripheral) functions of the facsimile device, printer and/or copier.

What is claimed is:

1. An ink cartridge comprising:

a supply core tube configured to supply an ink sheet rolled around the supply core tube;

a take-up core tube configured to take-up the ink sheet supplied from the supply core tube;

a frame;

supporting shafts provided at both ends of each of the supply core tube and the take-up core tube, wherein the frame rotatably supports the supply core tube and the take-up core tube via the supporting shafts, and wherein a supply side supporting shaft, which is one of the supporting shafts provided at both ends of the supply core tube, includes a core tube fixing member configured to connect with the supply core tube; and at least one opening formed at one longitudinal end portion of the supply core tube, the at least one opening allowing a tool to be inserted therethrough to access the core tube fixing member for disconnecting the supplying core tube and the supply side supporting shaft.

2. The ink cartridge according to claim 1, wherein the core tube fixing member releases a state in which the supply side supporting shaft is supported by the frame inside the supply core tube, the at least one opening allowing the tool to be inserted for causing the member to release the state in which the supply side supporting shaft is supported by the frame.

3. The ink cartridge according to claim 2, wherein the supply side supporting shaft includes:

a shaft member that rotatably supports the supply core tube with respect to the frame when the supply side supporting shaft is inserted in a supporting hole formed on the frame and an end portion of the shaft is connected with the core tube fixing member, wherein the core tube fixing member is configured to connect to an end of the shaft member, the core tube fixing member disconnecting from the shaft member when the tool is inserted through the at least one opening from outside of the supply core tube for causing disconnection.

4. The ink cartridge according to claim 3, wherein the supply side supporting shaft includes an elastic member that contacts the frame and applies an elastic force to the frame in a direction of the axis of the supply core tube, wherein, on an end portion of the shaft member opposite to the core tube fixing member with the frame arranged therebetween, a flange portion having a surface perpendicular to the axis of the shaft member is provided, and wherein the surface perpendicular to the axis of the shaft member is pressed against the frame by the elastic force generated by the elastic member.

5. The ink cartridge according to claim 4, wherein the core tube fixing member includes a member that is configured to be detachably fixed to the elastic member.

6. The ink cartridge according to claim 4, wherein a felt member is interposed between the flange portion and the frame, and wherein a plurality of protrusions are formed on the surface of the frame corresponding to the flange portion, the plurality of protrusions protruding into the felt member.

7. The ink cartridge according to claim 6, wherein a plurality of coaxial annular grooves is formed on the flange portion facing the frame with the felt member interposed therebetween.

8. The ink cartridge according to claim 3, wherein the supply core tube is formed with at least one stopper groove, and wherein the core tube fixing member is formed with at least one stopper protrusion that is configured to fit in the at least one stopper groove formed on the supply core tube.

9. The ink cartridge according to claim 3, wherein the supply side supporting shaft includes:

an engaging groove formed on the shaft member at a side end portion along a circumferential direction of the shaft member: and an engaging pawl formed on the core tube fixing member and extending toward the longitudinal center of the supply core tube along the axial direction thereof, the engaging pawl being configured to be elastically deformable in a direction of the diameter of the supply core tube, the engaging pawl being provided with an engaging protrusion which is configured to fit in the engaging groove when the supply core tube is supported by the frame, wherein the end portion of the shaft member and the core tube fixing member are connected as the engaging protrusion is fitted in the engaging groove, and wherein, when the connection between the end portion of the shaft member and the core tube fixing member is released, the engaging pawl is elastically deformed in the direction of the diameter of the supply core tube by the tool inserted through the at least one opening and the engaging protrusion is disengaged from the engaging groove.

10. The ink cartridge according to claim 9, wherein, when the engaging protrusion is fitted in the engaging groove, the tip end of the engaging pawl protrudes toward the longitudinal center of the supply core tube with respect to the tip end of the shaft portion.

11. The ink cartridge according to claim 9, wherein the supply core tube is formed with two openings at positions opposing each other with an inner space of the supply core tube therebetween, and wherein the core cube fixing member is configured such that, when the engaging pawl is elastically deformed in a direction perpendicular to a line connecting centers of the two openings and perpendicular to the axis of the supply core tube, the engaging protrusion is disengaged from the engaging groove.

12. The ink cartridge according to claim 2, wherein the at least one opening includes a plurality of openings.

13. The ink cartridge according to claim 1, wherein the at least one opening includes a plurality of openings.

14. The ink cartridge according to claim 1, wherein the supply core tube is made of paper.

15. An ink cartridge, comprising:

a frame;

a supply core tube configured to supply an ink sheet rolled around the supply core tube;

a supporting shaft that is connected with a longitudinal end portion of the supply core tube, the supply core tube being rotatably mounted to the frame via the supporting shaft;

a core tube fixing member that is configured to connect the supporting shaft with the supply core tube; and at least one opening allowing a tool to be inserted therethrough to access the core tube fixing member for disconnecting the supporting shaft from the supply core tube.

* * * * *

UNITED STATES PATENT AND TRADEMARK OFFICE

CERTIFICATE OF CORRECTION

PATENT NO. : 7,450,141 B2
APPLICATION NO. : 11/315104
DATED : November 11, 2008
INVENTOR(S) : Hideki Yamamoto It is certified that error appears in the above-identified patent and that said Letters Patent is hereby corrected as shown below:

In Column 18, Line 1 (Claim 11):
Please replace “cube” with --tube--

Signed and Sealed this

Twenty-eighth Day of July, 2009

John Doll

JOHN DOLL
*Acting Director of the United States Patent and Trademark Office*